US012339092B2

(12) United States Patent
Coalson

(10) Patent No.: US 12,339,092 B2
(45) Date of Patent: Jun. 24, 2025

(54) ARROW REST WITH DECOUPLED LAUNCH ASSEMBLY

(71) Applicant: Good Sportsman Marketing, LLC, Irving, TX (US)

(72) Inventor: Damon Coalson, Dallas, TX (US)

(73) Assignee: Good Sportsman Marketing, LLC, Irving, TX (US)

( * ) Notice: Subject to any disclaimer, the term of this patent is extended or adjusted under 35 U.S.C. 154(b) by 141 days.

(21) Appl. No.: 18/204,935

(22) Filed: Jun. 1, 2023

(65) Prior Publication Data

US 2023/0400278 A1 Dec. 14, 2023

Related U.S. Application Data

(60) Provisional application No. 63/351,809, filed on Jun. 13, 2022.

(51) Int. Cl.
*F41B 5/14* (2006.01)

(52) U.S. Cl.
CPC ..... *F41B 5/143* (2013.01)

(58) Field of Classification Search
CPC ..... F41B 5/143
USPC ..... 124/86
See application file for complete search history.

(56) References Cited

U.S. PATENT DOCUMENTS

| | | | | |
|---|---|---|---|---|
| 5,490,491 | A | 2/1996 | Troncoso | |
| 5,722,381 | A | 3/1998 | Mizek | |
| 6,178,959 | B1 | 1/2001 | Troncoso | |
| 6,615,813 | B1 | 9/2003 | Troncoso | |
| 6,915,791 | B2 | 7/2005 | Harwath | |
| 7,331,338 | B2 | 2/2008 | Mizek | |
| 7,409,950 | B2 | 8/2008 | Ellig | |
| 7,681,566 | B2 | 3/2010 | Mertens | |
| 7,717,103 | B2 | 5/2010 | Johnson | |
| 8,544,457 | B1 | 10/2013 | Munsell | |
| 10,823,525 | B1 * | 11/2020 | Stevens | F41B 5/143 |
| 2008/0236556 | A1 | 10/2008 | Sims | |
| 2009/0101127 | A1 * | 4/2009 | Johnson | F41B 5/143 124/44.5 |
| 2011/0139138 | A1 * | 6/2011 | Geno | F41B 5/143 124/44.5 |
| 2017/0074614 | A1 * | 3/2017 | Nystrom | F41B 5/143 |
| 2018/0058798 | A1 * | 3/2018 | Coalson | F41B 5/143 |

* cited by examiner

*Primary Examiner* — John E Simms, Jr.
(74) *Attorney, Agent, or Firm* — Cabello Hall Zinda, PLLC

(57) ABSTRACT

An arrow rest with a decoupled launch assembly comprises a rest rotatably mounted to a shaft and coupled to the shaft via a biasing device. An actuator connects the shaft to a portion of a bow allowing movement of the bow to actuate the decoupled launch assembly between a raised state and dropped state by rotation of the shaft. The biasing device flexibly couples movement of the rest and shaft permitting the shaft to further rotate after a dropped state has been achieved.

20 Claims, 9 Drawing Sheets

ARROW REST WITH DECOUPLED LAUNCH ASSEMBLY

CROSS-REFERENCE TO RELATED APPLICATION

This application claims the benefit of U.S. Provisional Patent Application No. 63/351,809, filed Jun. 13, 2022.

BACKGROUND OF THE INVENTION

1. Field of the Invention

The invention relates to archery and in particular to an arrow rest with a decoupled launch assembly.

2. Related Art

Arrow rests help with accuracy and consistency when firing arrows. Certain types of arrow rests contact an arrow, such as its fletching, as the arrow is fired, which can cause the arrow's flight to become unpredictable. A drop away arrow rest falls away from the arrow when fired and thus typically does not touch the arrow as it is fired.

From the discussion that follows, it will become apparent that the present invention addresses the deficiencies associated with the prior art while providing numerous additional advantages and benefits not contemplated or possible with prior art constructions.

SUMMARY OF THE INVENTION

An arrow rest with a decoupled launch assembly is disclosed herein. As will be described further below, the decoupled launch assembly, provides a flexible or decoupled connection between a bow and a rest. As such, the arrow rest is more readily installed and tuned in that the precision required in installation and tuning of traditional arrow rests is not required. In addition, the arrow rest can operate properly without tuning even as bow components stretch, move, or otherwise change over time.

Various arrow rests and methods therefor are disclosed herein. For instance, in one exemplary embodiment, an arrow rest for a bow is provided, with such arrow rest comprising a housing and a shaft mounted to the housing. The shaft is rotatable between first position and a second position with an intermediary position therebetween.

An actuator is attached to the shaft for connecting to a portion of the bow. A rest, rotatable relative to the shaft, is mounted to the shaft. A biasing device is attached to the shaft and flexibly coupling the rest to the shaft.

When the shaft is rotated to the first position the rest is rotated to a raised state, and when the shaft is rotated to the intermediary position the rest is rotated to a dropped state, and when the shaft is rotated from the intermediary position to the second position the rest is maintained in the dropped state. The biasing device is distorted by torsional forces when the shaft is rotated from the intermediary position to the second position.

In one or more embodiments, a rigid actuation member may be attached to the actuator for connecting the actuator to the portion of the bow is included. In addition, a rotation limiter may be affixed to the shaft and a stop attached to the housing. The rotation limiter engages the stop when the shaft is rotated to the first position. The rotation limiter may also engage the stop when the shaft is rotated to the second position. In addition, the rotation limiter may be disengaged from the stop when the shaft is in the intermediary position.

A targeting adjustment assembly comprising one or more clamping assemblies engaged to one or more tracks may also be provided. The clamping assemblies are preloaded to engage the tracks with one or more springs. The tracks may be oriented to provide elevation or windage adjustment, or both. The actuator and rest may generally be at opposing ends of the shaft.

In another exemplary embodiment, the arrow rest comprises a housing having a stop and a shaft rotatably mounted to the housing. The shaft is rotatable between first position and a second position with an intermediary position therebetween. A rotation limiter is mounted to the shaft and limits the rotation of the shaft by engaging the stop when the shaft is rotated to the first position and the second position.

A rest is rotatably mounted to the shaft, and a biasing device attached to the shaft. The biasing device flexibly couples the shaft to the rest such that when the shaft is rotated to the first position the rest is rotated to a raised state, when the shaft is rotated to the intermediary position the rest is rotated to a dropped state, and when the shaft is rotated from the intermediary position to the second position the biasing device is distorted by the rotation while the rest is maintained in the dropped state.

In one or more embodiments, the biasing device may be a torsion spring, and the shaft extends through the biasing device. In addition, an actuator may be attached to the shaft for connecting to a portion of a bow. A rigid actuation member may be attached to the shaft for connecting to a portion of a bow as well. A shaft biasing device may be included to flexibly couple the shaft to the housing. The shaft biasing device biases the shaft to a particular position.

A targeting adjustment assembly comprising one or more clamping assemblies engaged to one or more tracks may be provided as well. The clamping assemblies are preloaded to engage the tracks with one or more springs. The tracks may be oriented to provide elevation or windage adjustment.

In another exemplary embodiment, an arrow rest comprises a shaft mounted to the housing and having a first end and a second end. The shaft is rotatable between first position and a second position with an intermediary position therebetween.

A rest is mounted to the shaft and is rotatable relative to the shaft. A biasing device is attached to the shaft and flexibly couples the rest to the shaft. The rest is rotated to a raised state via the biasing device when the shaft is rotated to the first position, the rest is rotated to a dropped state via the biasing device when the shaft is rotated to the intermediary position, and the rest is maintained in the dropped state when the shaft is rotated to the second position. A load distorts the biasing device only when the shaft is rotated from the intermediary position to the second position.

The first position and second position may be defined by a rotation limiter affixed to the shaft. In addition, an actuator may be coupled to the shaft for connecting to a portion of a bow. A rigid actuation member coupled to the shaft for connecting to a portion of a bow as well. A shaft biasing device may be attached to the shaft and bias the shaft and the rest to a particular position.

A targeting adjustment assembly comprising one or more clamping assemblies engaged to one or more tracks may be included. The clamping assemblies are preloaded to engage the tracks with one or more springs.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The arrow rest disclosed herein includes a decoupled launch assembly that simplifies proper installation and tuning of the arrow rest, while providing the benefit of improved consistency by dropping away to avoid contact with a fired arrow. This is unlike traditional drop away arrow rests which are difficult to install and require regular tuning to maintain consistent operation.

In addition, as a bow's components stretch, move, or otherwise change over time, a traditional drop away rest may not continue to drop away as desired, causing unwanted contact between the drop away rest and a fired arrow. The decoupled launch assembly included in the arrow rest herein, among other things, addresses this issue.

Figure 1:
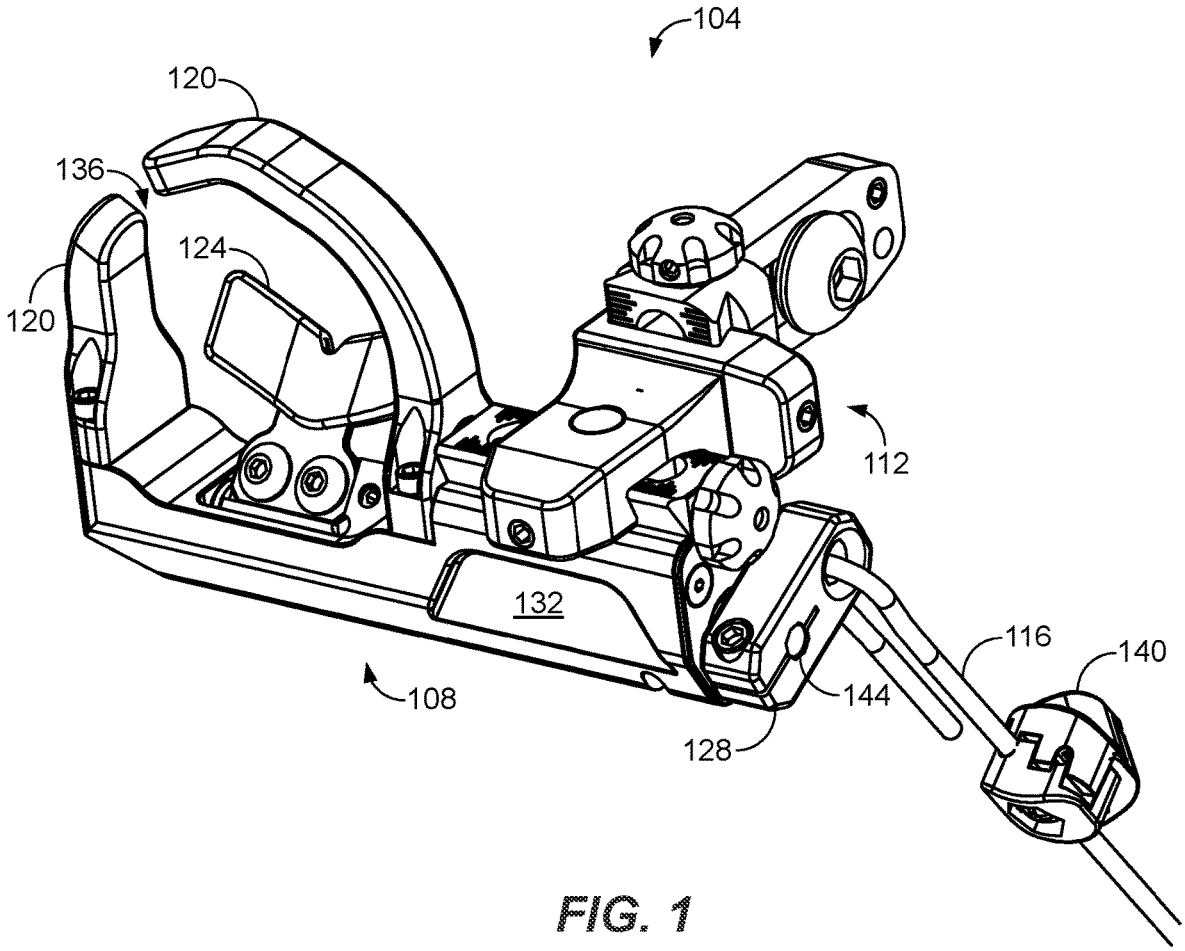
FIG. 1 is a front perspective view of an exemplary arrow rest.

FIG. 1 illustrates a perspective view of an exemplary arrow rest 104. As can be seen, the arrow rest 104 may comprise a cage 120 defining an open area 136 with a rest 124 for holding an arrow, an adjustment assembly 112 for windage, elevation, or other targeting adjustments, and an actuator 128 that actuates the rest when rotated, moved, or otherwise actuated. A body or housing 132 will typically be provided to house and support one or more components of a decoupled launch assembly 108 as well as other components of the arrow rest 104, as can be seen from FIG. 1.

The actuator 128 may be connected to a bow limb or other portion of a bow by an actuation member 116. The actuation member 116 will typically be a rigid member such that the actuator 128 is rigidly connected to the bow, such as via a clamp or other connector 140. As shown in FIG. 1 for example, the actuation member 116 is a rod.

Figure 2:
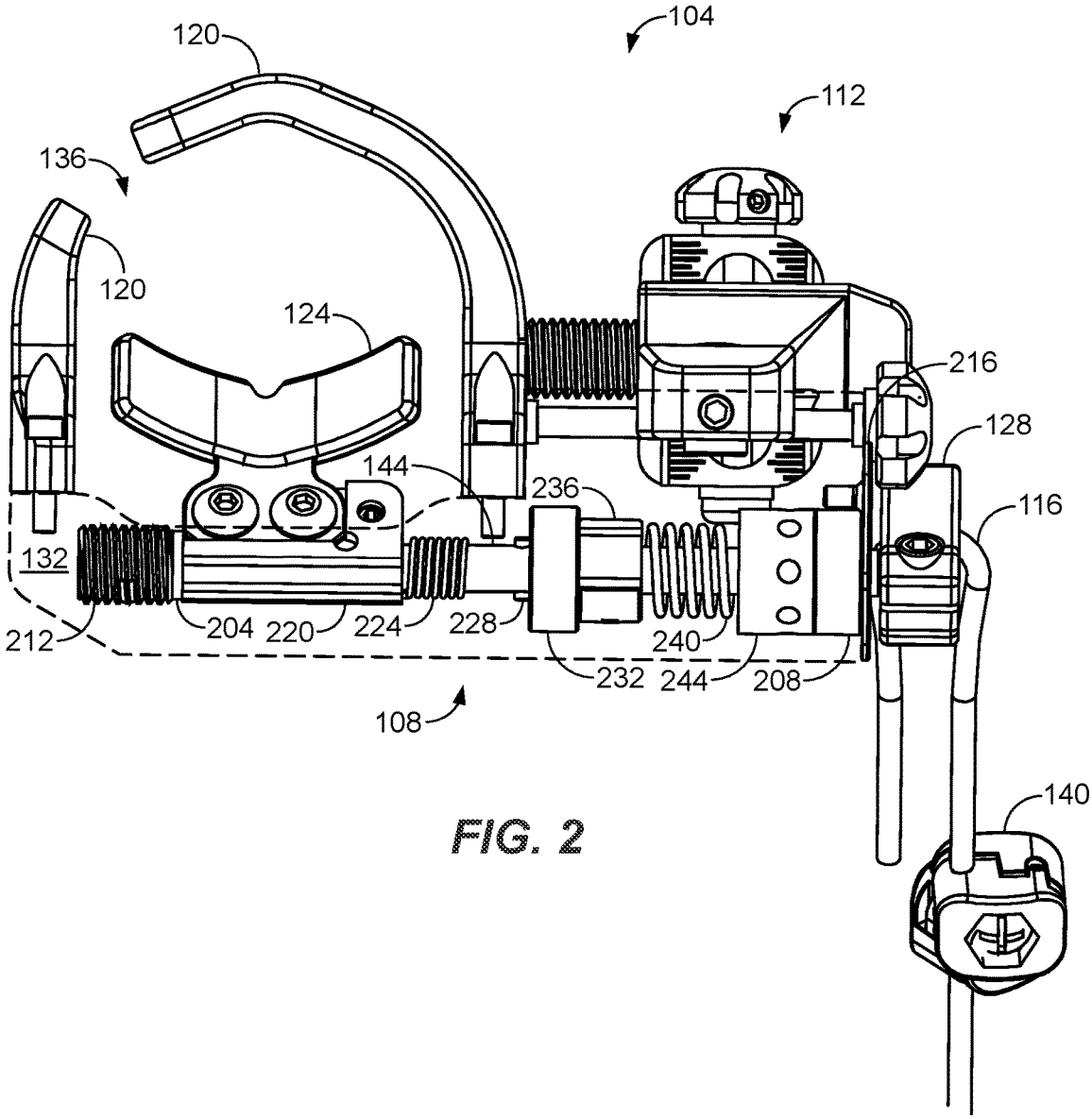
FIG. 2 is a front view of an exemplary arrow rest and decoupled launch assembly.
Figure 3:
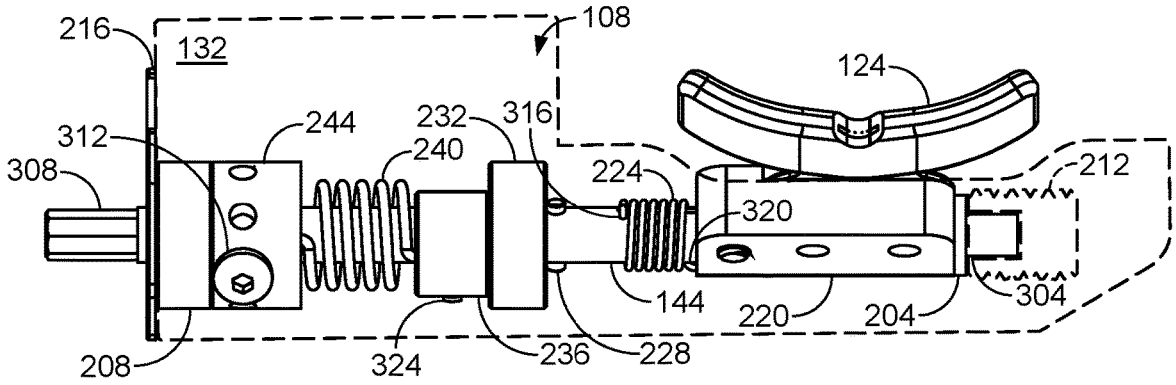
FIG. 3 is a front perspective view of an exemplary decoupled launch assembly.

FIGS. 2 and 3 respectively illustrate a front and rear view of the exemplary decoupled launch assembly 108. As can be seen from FIG. 2, various components of the decoupled launch assembly 108 may be housed within or otherwise supported by the housing 132.

The decoupled launch assembly 108 may comprise one or more shafts, bushings, biasing devices, bearings, washers, mounts, disks, or various subsets thereof. For instance, as can be seen in the exemplary embodiment of FIGS. 2 and 3, the decoupled launch assembly 108 may comprise a shaft 144 rotatably mounted to the housing 132 via one or more bearings 208, 232, and end bushings 212, or both. One or more mounting plates 216 may be used to secure the bearing 208, 232 to the housing 132. One or more washers 204, may be provided as well and may comprise friction reducing material, such as TEFLON to facilitate rotation and movement.

Figure 4:
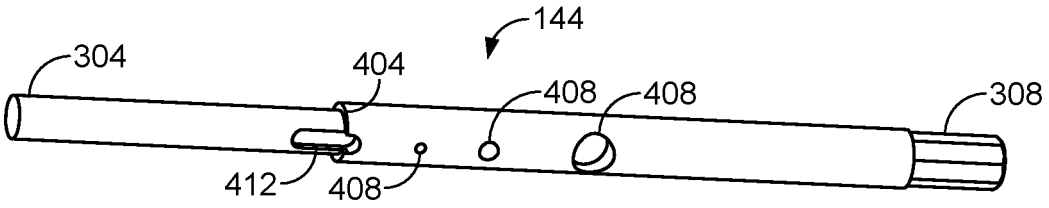
FIG. 4 is a perspective view of an exemplary shaft of a decoupled launch assembly.

In one or more embodiments, the shaft 144, such as illustrated in FIG. 4, generally extends along a dimension of the arrow rest 104. The shaft 144 may comprise a first end 304 and a second end 308. The first end 304 may rotatably engage the end bushing 212, which allows the shaft 144 to rotate freely therein. It is noted that though the end bushing 212 is shown with a threaded exterior for mounting to a threaded portion of the housing 132, a bushing may be secured to a housing in various ways. In one or more embodiments, the shaft 144 may be formed as a single unitary structure.

The second end 308 of the shaft 144 may be attached to the actuator 128 that rotates the shaft 144. For example, the actuator 128 may be an arm, lever, or the like that rotates its shaft 144. It is contemplated that the second end 308 of the shaft 144 may be faceted or otherwise shaped so as to engage a corresponding socketed portion of the actuator 128, allowing rotation of the actuator 128 to efficiently transfer movement to the shaft 144.

The shaft 144 may, in some embodiments, have varying diameters or otherwise be contoured along its length. As shown in FIG. 4 for example, the shaft 144 has a reduced diameter proximate its first end 304 demarcated by the flange or one or more steps 404 thereof. The one or more steps 404 may be provided to position and secure various components along the shaft 144. For example, a rest bushing 220 may engage the step 404 when installed thereby positioning the rest bushing along the shaft 144.

The shaft 144 may also comprise one or more features for mounting components of the decoupled launch assembly 108. As also shown in FIG. 4, one or more slots 412, holes 408, or other openings may be part of the shaft 144. These features may be used to receive or otherwise engage various components of the decoupled launch assembly 108, such as for mounting purposes. For instance, with reference to FIGS. 2 and 3, a pin 228 is received at the hole 408 in the shaft 144 to secure the bearing 232.

Figure 5:
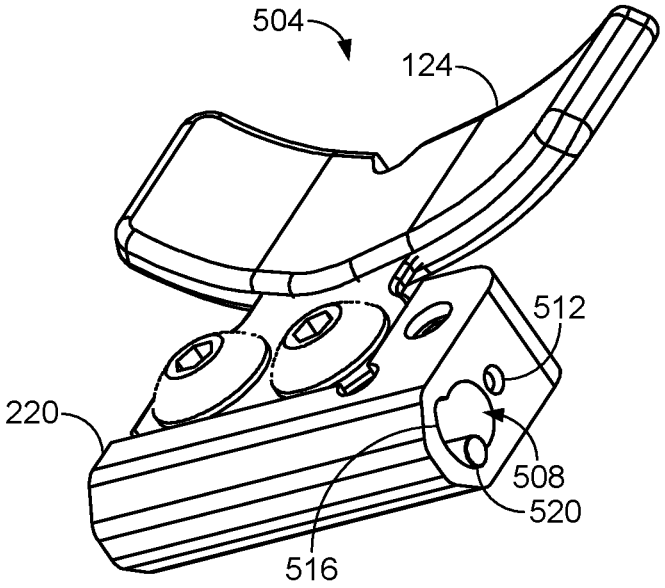
FIG. 5 is a bottom perspective view of an exemplary rest assembly.

FIG. 5 illustrates a bottom perspective view of an exemplary rest assembly 504, which may comprise the rest bushing 220 with the rest 124 fixed thereto. As can be seen, the rest bushing 220 may comprise one or more open portions 508 for receiving the shaft 144.

The rest assembly 504 may comprise a limiter to control or limit its rotation. For example, the open portion 508 may have a compartment to receive a pin 520 in one or more embodiments. When assembled to the shaft 144, such pin 502 may also be received in a slot 412, as shown in FIG. 4, of the shaft 144 to control or limit rotation of the rest bushing 220.

In the embodiment of FIG. 5, the open portion 508 has an arcuate compartment 516 defining a path along which the pin 520 can roll or otherwise move when the rest bushing 220 is rotated, with the extents of the compartment defining the limits of rotation for the rest bushing.

Referring back to FIGS. 2 and 3, the rest bushing 220 will typically be rotatably mounted to the shaft 144 such as via the open portion 508 thereof. In this manner, the rest assembly 504 can freely rotate in a decoupled manner relative to the shaft 144, as may be limited by the limiter such as described above.

A rest biasing device 224, which may be a torsion or other spring, will typically be provided to bias the rest bushing 220 and its attached rest 124 to a particular position. Typically, the rest biasing device 224 will bias the rest 124 toward a downward or dropped position to avoid contact between the rest 124 and a fired arrow. As will be described further below, the rest biasing device 224 will typically also function as a flexible or decoupled connection that allows the rest 124 to rotate in keeping with and separate from other components of the decoupled launch assembly 108, such as the shaft 144 thereof.

As can be seen in the rear view of FIG. 3, the rest biasing device 224 may connect at a first end 316 to the shaft 144 and at a second end 320 to the rest bushing 220 thereby allowing the rest bushing and rest 124 to be connected to and biased relative to the shaft 144. It is noted that the rest biasing device 224 may be connected at first and second portions rather than at its first and second ends in one or more embodiments.

A shaft biasing device 240, which may be a torsion or other spring, may be provided as well to bias the shaft 144 to a particular position. In one or more embodiments, the shaft biasing device 240 may bias the shaft 144 in an opposite direction as compared to the rest biasing device 224. For instance, the shaft biasing device 240 will typically bias the shaft 144 such that its rest 124 is in a raised position.

The shaft biasing device 240 may be secured to one or more mounts 244 and one or more rotation limiters 236. As can be seen in the rear view of FIG. 3 for instance, a first portion of the shaft biasing device 240 is connected to the mount 244, while a second portion of the shaft biasing device 240 is connected to the rotation limiter 236. The rotation limiter 236 may be fixed to the shaft 144, while the mount 244 is rotatable or decoupled relative to the shaft 144.

In the exemplary embodiment of FIG. 3, the rotation limiter 236 is fixed to the shaft 144 via a set screw 324, while the mount 244 is rotatable relative to the shaft 144 and fixed to the housing 132, such as with a fastener 312. The set screw 324 may be received in one of the holes 408 of the shaft 144 to help ensure that the rotation limiter 236 is fixed to the shaft 144.

It is noted that one or more portions of the decoupled launch assembly 108 may be integrally formed with the shaft 144 in some embodiments. For example, the rotation limiter 236 or the mount 244, if intended to be fixed relative to the shaft 144, may be formed as part of the shaft 144.

Figure 6:
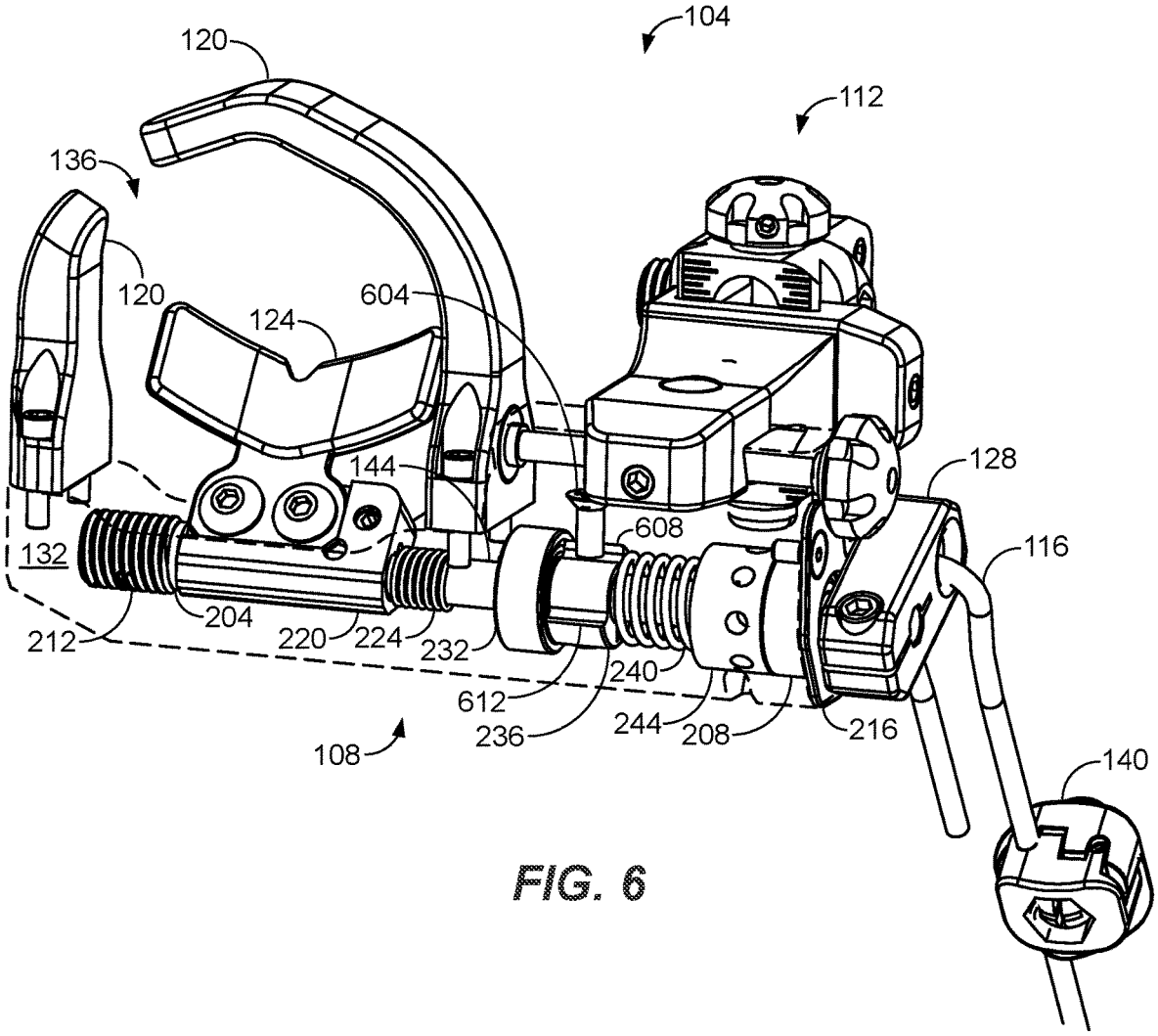
FIG. 6 is a front perspective view of an exemplary arrow rest and decoupled launch assembly.

FIG. 6 illustrates a front perspective view of the exemplary arrow rest 104 and the decoupled launch assembly 108. As can be seen, a stop 604 may be provided to limit rotation of the shaft 144 when the rotation limiter 236 engages the stop 604. In one or more embodiments, the stop 604 may be fixed to the housing 132 or other structure. The rotation limiter 236 may comprise one or more structural features, such as one or more flanges 608, 612, for engaging the stop 604 to limit rotation to a particular range.

Operation of the exemplary decoupled launch assembly 108 will now be described with respect to FIGS. 7-9. As will now be described, the rest assembly 504 of the decoupled launch assembly 108 may rotate generally synchronous with the shaft 144 from a raised state to a dropped state. When the dropped state is achieved, the shaft 144 may continue to rotate while the rest assembly 504 does not rotate due to the decoupled nature of the decoupled launch assembly 108.

Figure 7:
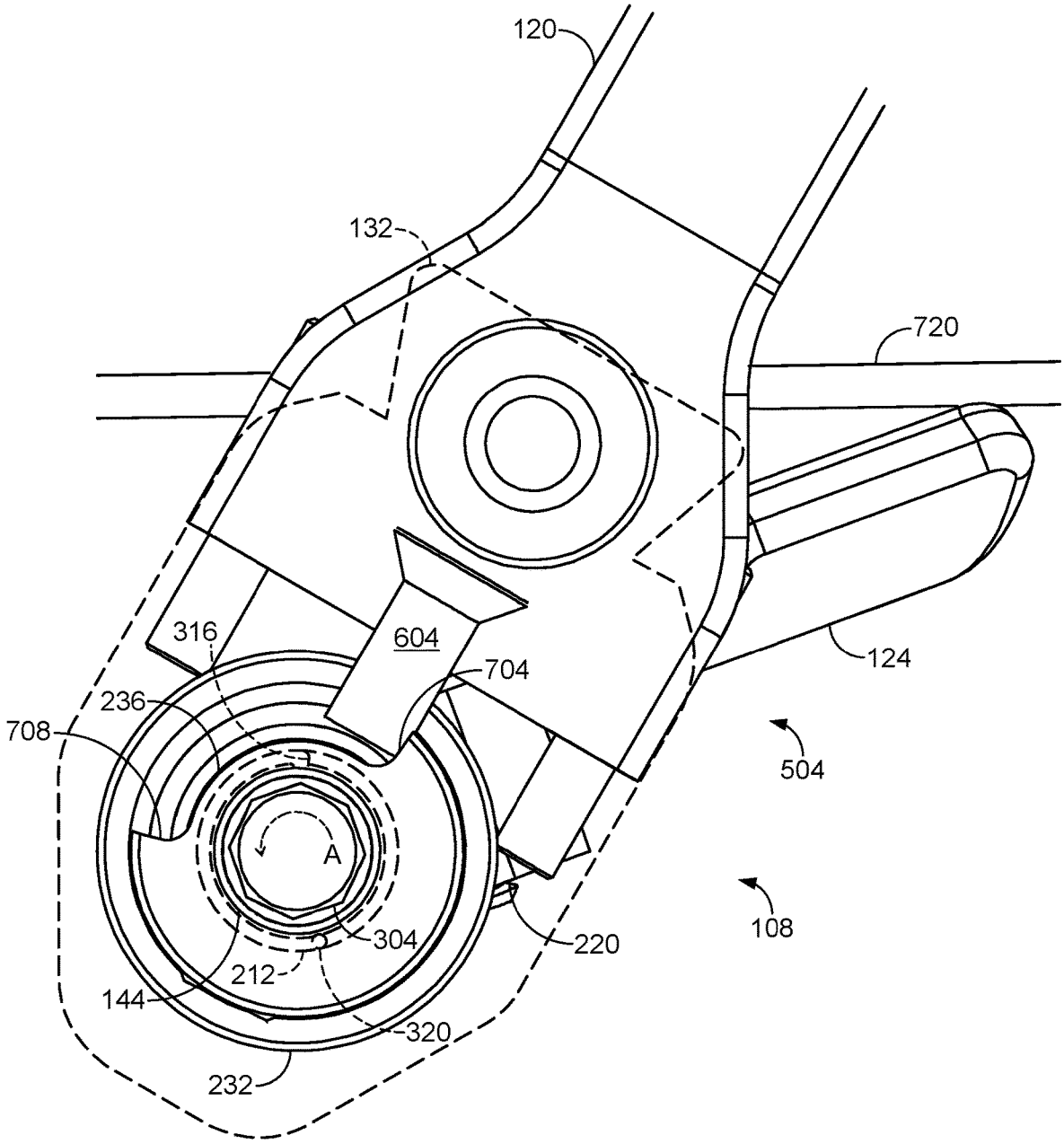
FIG. 7 is a side view illustrating operation of an exemplary arrow rest in a raised state.

FIG. 7 illustrates the exemplary decoupled launch assembly 108 in a raised state where the rest 124 is at a raised position to hold an arrow 720 for firing. The raised state may be achieved by the shaft biasing device 240 rotating the shaft 144, in the direction indicated by arrow A, such that the rotation limiter 236 engages the stop 604. For instance, such rotation may occur when a bow limb is flexed introducing slack at the actuation member 116 and the actuator 128.

The rest biasing device 224 may rotate with the shaft 144 thereby raising the rest bushing 220 and the rest 124 to a raised state as well, as can be seen from FIG. 7. In one or more embodiments, the stop 604 may be engaged by a first flange 704 of the rotation limiter 236 when the raised state is achieved. The first flange 704 and the stop 604 may then prevent the rest 124 from rotating further.

Figure 8:
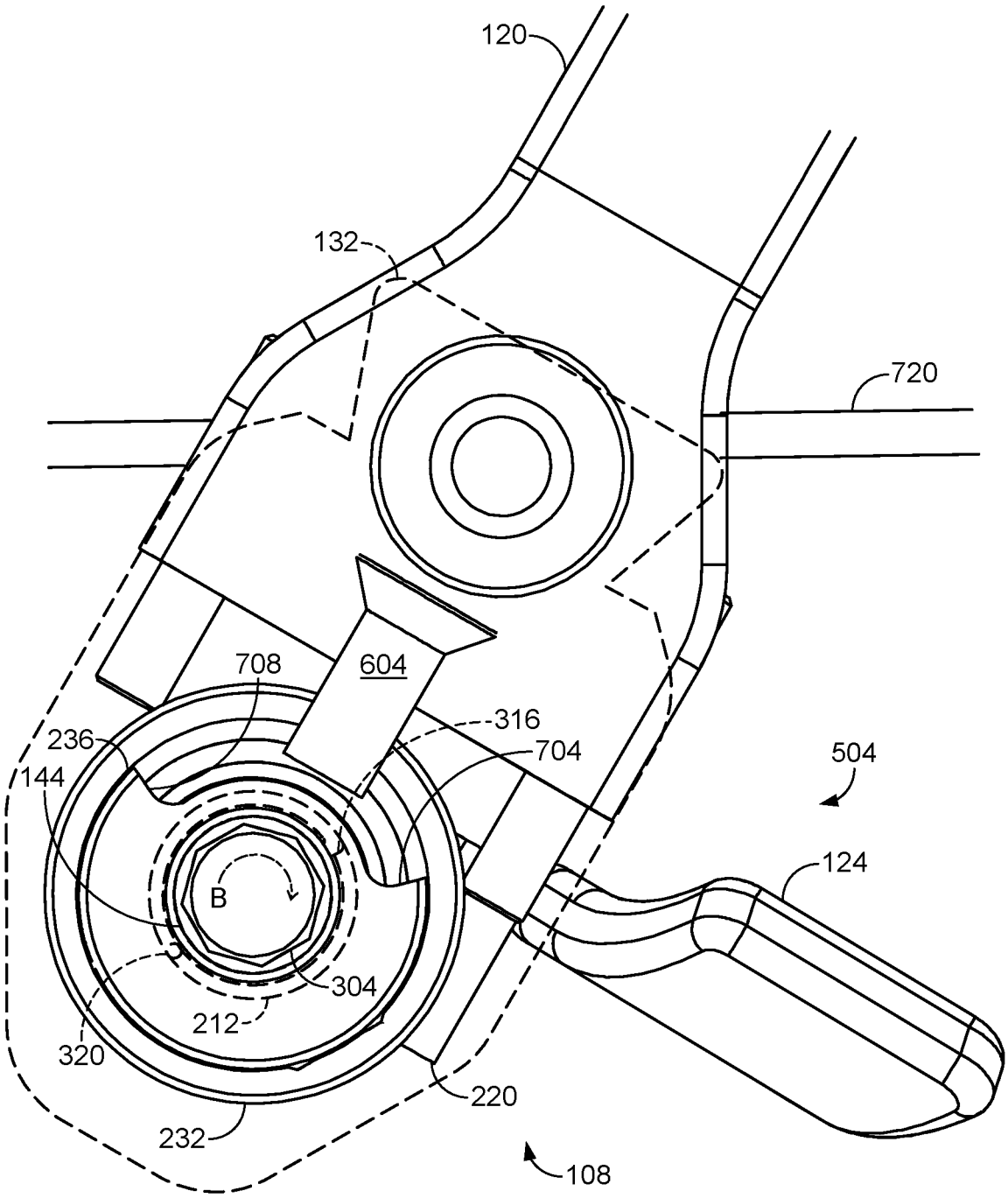
FIG. 8 is a side view illustrating operation of an exemplary arrow res in a dropped state.

FIG. 8 illustrates the decoupled launch assembly 108 in a dropped state where the decoupled launch assembly 108 is rotated downward such that the rest 124 is at a dropped position downward and away from the arrow 720. In the dropped state, the rest 124 may be at its lowest position as may be defined by engagement between the rest bushing 220, the rest 124, or both and a portion of the housing 132, such as a stop or the like of the housing 132.

The dropped state may be achieved by rotating the shaft 144 in the direction indicated by arrow B. For example, such rotation may occur when the actuation member 116 is pulled as a bow limb relaxes as the arrow 720 is fired, which in turn rotates the actuator 128 that rotates the shaft 144.

As can be seen in FIG. 8, although the decoupled launch assembly 108 is in a dropped state with the rest 124 in a dropped position, the second flange 708 has not engaged the stop 604. In other words, the shaft 144 and the rotation limiter 236 are at an intermediary position in FIG. 8 where no engagement is being made with the stop 604, yet the rest 124 is at a dropped position.

Figure 9:
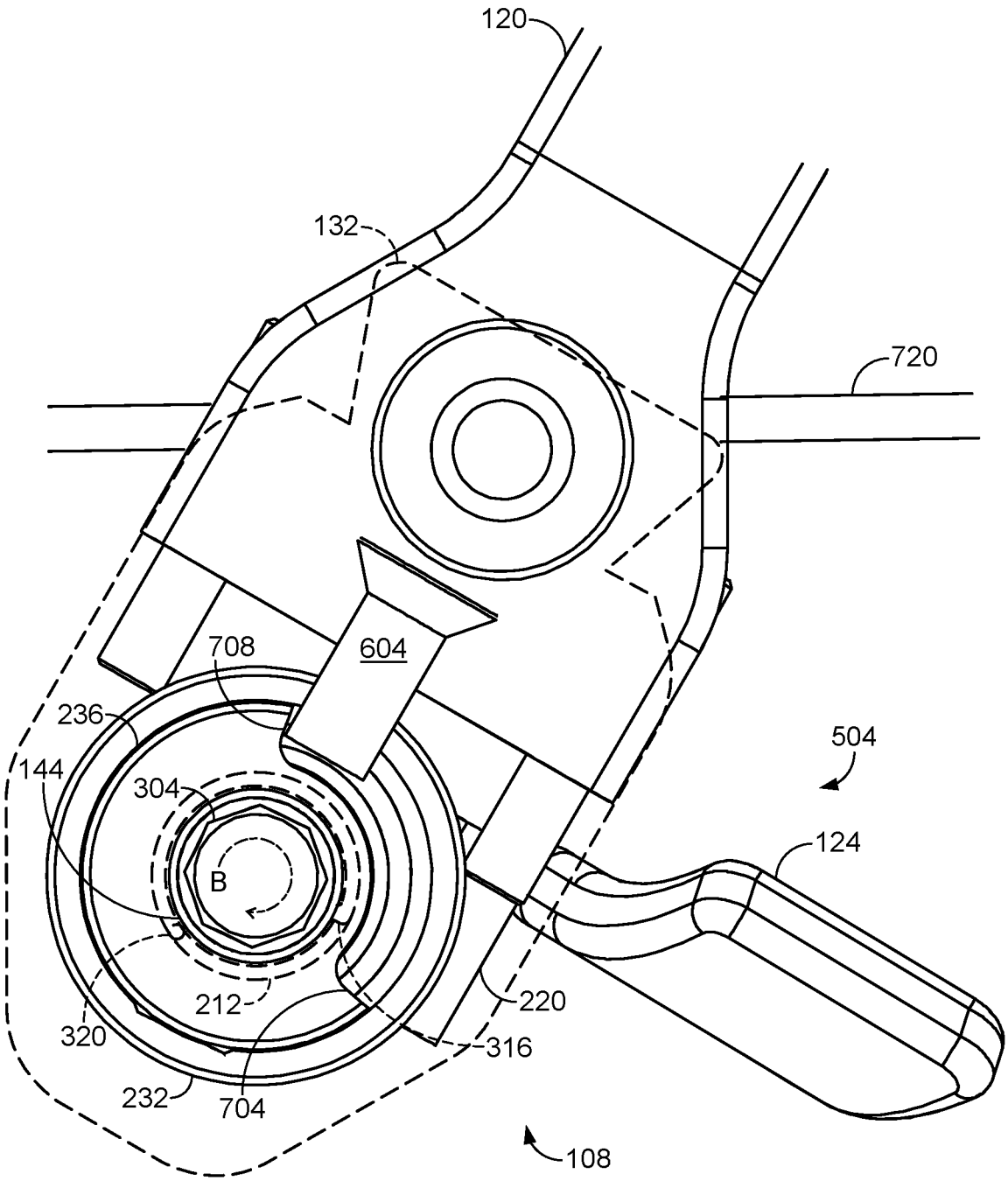
FIG. 9 is a side view illustrating operation of an exemplary arrow rest in a dropped state.

As such, as shown in FIG. 9, the shaft 144 may be further rotated in the direction indicated by arrow B, while the rest 124 remains in the dropped position. In this manner, the rotation of the shaft 144 is decoupled from the rest bushing 220 and the rest 124. The rest biasing device 224 absorbs this additional rotation by twisting or otherwise distorting because of this load as shown by the movement of the first end 316 of the rest biasing device 224 relative to its position in FIG. 8. Rotation may continue until the shaft 144 rotates such that a second flange 708 of the rotation limiter 236 engages the stop 604 as shown in FIG. 9.

This ability to absorb or otherwise accept additional rotation is advantageous in that it increases the range of motion for the actuator 128 and the actuation member 116 thereby also allowing the decoupled launch assembly 108 to compensate for a larger range of motion of a bow's components. As such, installation and tuning of the arrow rest 104 is simplified more readily achievable, at least for the reason that the arrow rest 104 need not be tuned precisely for the particular movements of a bow. In addition, proper operation of the arrow rest 104 is maintained even as components of a bow move, stretch, or otherwise change, providing increased firing consistency over time without the need for additional tuning.

Figure 10:
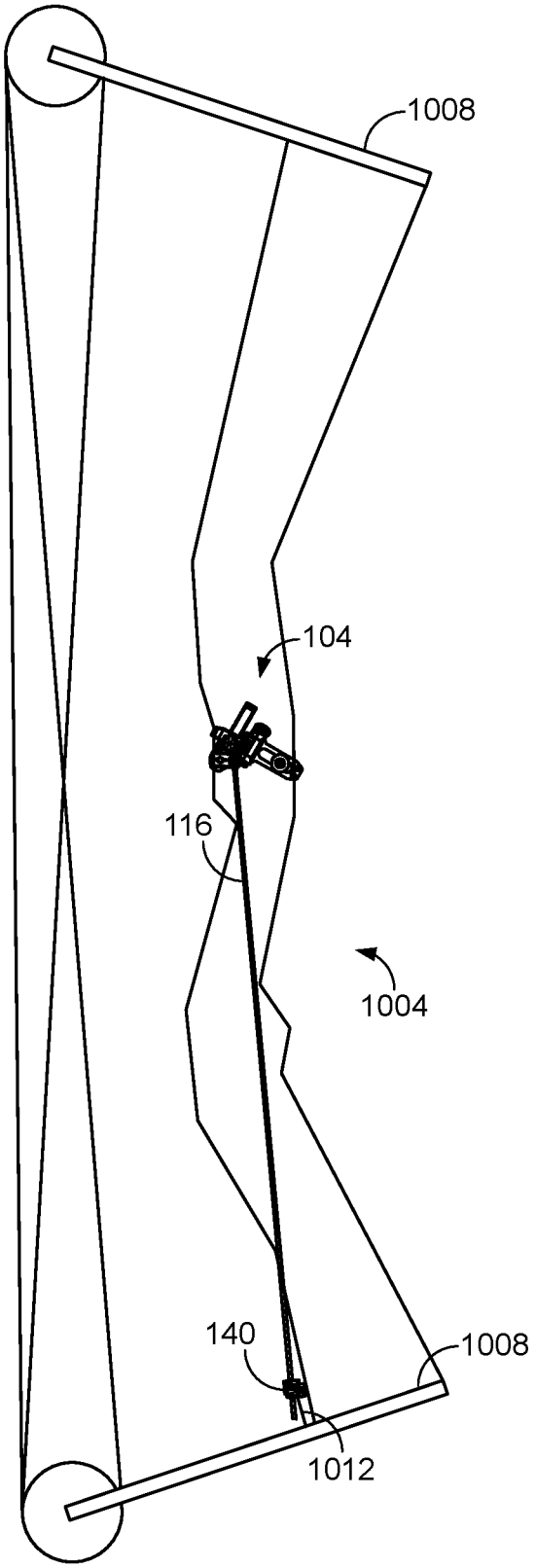
FIG. 10 is a side view of an exemplary arrow rest in an environment of use.

FIG. 10 illustrates a side view of the exemplary arrow rest 104 in an exemplary environment of use. Namely, the arrow rest 104 is installed on a bow 1004. As can be seen, the actuation member 116 may be connected to the bow 1004 at a bow limb 1008, such as via the connector 140. The connector 140 may be directly connect to the bow 1004 or may be connected to the bow 1004 via one or more linkages 1012. The linkage 1012 will typically be a rigid structure. Although illustrated as connected to a particular bow limb 1008, it will be understood that the arrow rest 104 may be connected to various portions of a variety of bows 1004.

It is noted that the connection between the bow 1004 and the arrow rest 104 need not be damped due to the decoupled launch assembly 108's ability to accept additional rotation. The lack of such damped connection also improves the responsiveness of the arrow rest 104 in that bow limb movement is more directly transmitted to the arrow rest 104 when there is no intermediate dampening componentry therebetween.

Figure 11:
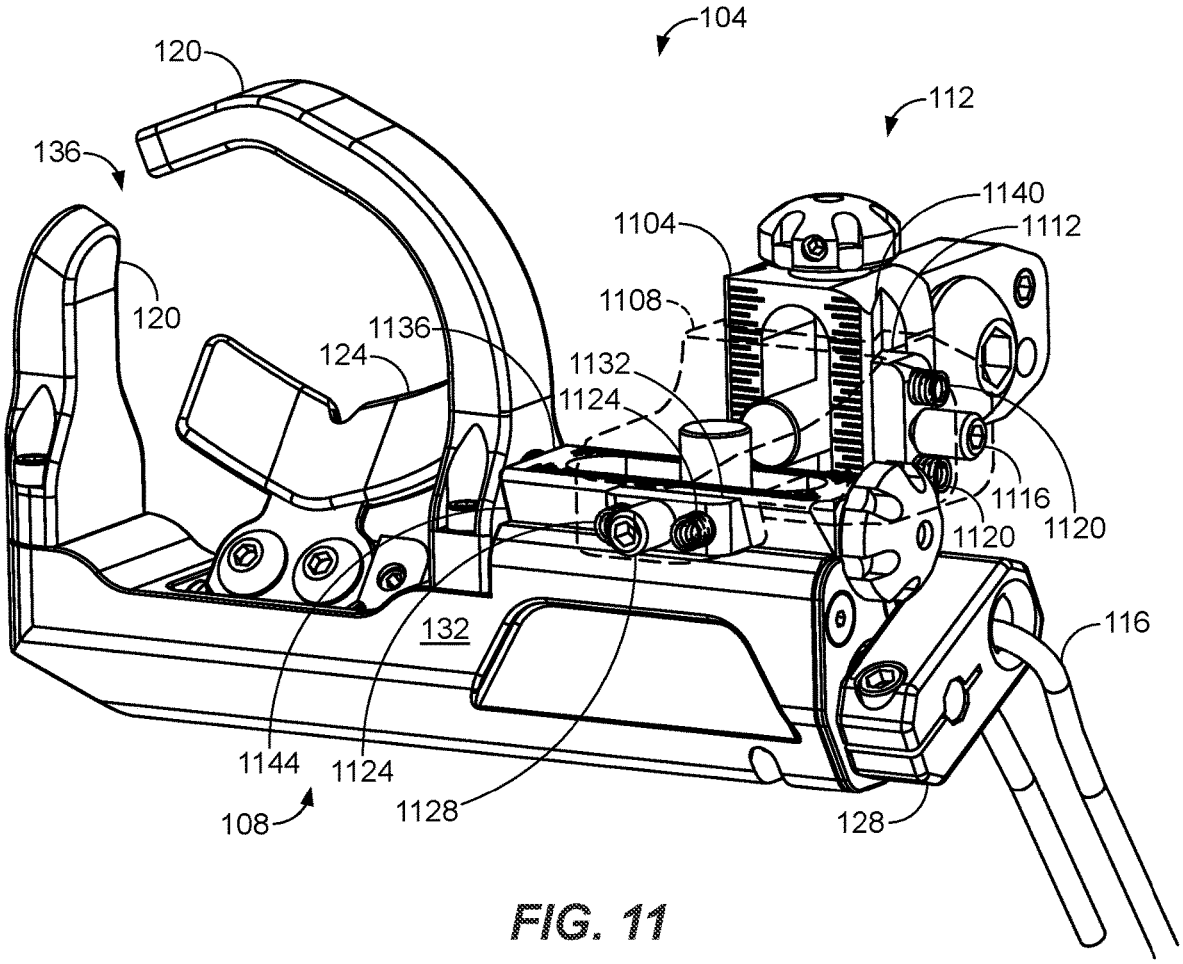
FIG. 11 is a perspective view of an exemplary arrow rest and adjustment assembly.

Referring to FIG. 11, the arrow rest 104 also includes improvements relating to targeting adjustments. FIG. 11 illustrates a front perspective view of the exemplary arrow rest 104 and the adjustment assembly 112 with an enclosure or housing 1108 thereof removed.

As can be seen, the adjustment assembly 112 may comprise clamping assemblies comprising shoes 1112, 1132, preloaded with one or more biasing devices 1120, 1124, such as springs, and corresponding tracks 1140, 1144. The shoes 1112, 1132 may be secured in place by one or more fasteners 1116, 1128, such as one or more set screws, once adjustments are complete.

The biasing device 1120, 1124 forces the shoe 1112, 1132 into contact with its respective gauge body 1104, 1136 even when the fasteners 1116, 1128 are loosened or otherwise disengaged to permit adjustment, when the actuation member 116 is pulling against the arrow rest 104, or both. Maintaining the position of the shoe 1112, 1132 adjacent its gauge body 1104, 1136, even when the fasteners 1116, 1128 are disengaged, facilities precise alignment with one or more gauge marks because the shoe is maintained proximate the gauge marks of the gauge body.

The wedge or angled shape of the shoe 1112, 1132 and correspondingly shaped track 1140, 1144 of its gauge body 1104, 1136 also aids the biasing device 1120, 1124 in holding a shoe adjacent its gauge body.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An arrow rest for a bow comprising:

a housing;

a shaft mounted to the housing, the shaft being rotatable between a first position and a second position with an intermediary position therebetween;

an actuator attached to the shaft for connecting to a portion of the bow;

a rest mounted to the shaft, wherein the rest is rotatable relative to the shaft; and a biasing device attached to the shaft and flexibly coupling the rest to the shaft;

wherein when the shaft is rotated to the first position the rest is rotated to a raised state, when the shaft is rotated to the intermediary position the rest is rotated to a dropped state, and when the shaft is rotated from the intermediary position to the second position the rest is maintained in the dropped state; and wherein the biasing device is distorted by torsional force when the shaft is rotated from the intermediary position to the second position.

2. The arrow rest of claim 1, further comprising a rigid actuation member for connecting the actuator to the portion of the bow, the rigid actuation member attached to the actuator.

3. The arrow rest of claim 1, further comprising a rotation limiter affixed to the shaft and a stop attached to the housing, wherein the rotation limiter engages the stop when the shaft is rotated to the first position.

4. The arrow rest of claim 3, wherein the rotation limiter engages the stop when the shaft is rotated to the second position.

5. The arrow rest of claim 4, wherein the rotation limiter is disengaged from the stop when the shaft is in the intermediary position.

6. The arrow rest of claim 1, further comprising a targeting adjustment assembly comprising one or more clamping assemblies engaged to one or more tracks, wherein the one or more clamping assemblies are preloaded to engage the one or more tracks with one or more springs.

7. The arrow rest of claim 1, wherein the actuator and rest are generally at opposing ends of the shaft.

8. An arrow rest comprising:

a housing having a stop;

a shaft rotatably mounted to the housing, the shaft being rotatable between a first position and a second position with an intermediary position therebetween;

a rotation limiter mounted to the shaft, wherein the rotation limiter limits the rotation of the shaft by engaging the stop when the shaft is rotated to the first position and the second position;

a rest rotatably mounted to the shaft; and a biasing device attached to the shaft, the biasing device flexibly coupling the shaft to the rest, wherein when the shaft is rotated to the first position the rest is rotated to a raised state, when the shaft is rotated to the intermediary position the rest is rotated to a dropped state, and when the shaft is rotated from the intermediary position to the second position the biasing device is distorted by the rotation while the rest is maintained in the dropped state.

9. The arrow rest of claim 8, wherein the biasing device is a torsion spring and the shaft extends through the biasing device.

10. The arrow rest of claim 8, further comprising an actuator attached to the shaft for connecting to a portion of a bow.

11. The arrow rest of claim 8, further comprising a rigid actuation member attached to the shaft for connecting to a portion of a bow.

12. The arrow rest of claim 8, further comprising a shaft biasing device flexibly coupling the shaft to the housing, wherein the shaft biasing device biases the shaft to a particular position.

13. The arrow rest of claim 8, further comprising a targeting adjustment assembly comprising one or more clamping assemblies engaged to one or more tracks, wherein the one or more clamping assemblies are preloaded to engage the one or more tracks with one or more springs.

14. The arrow rest of claim 13, wherein the one or more tracks are oriented to provide elevation or windage adjustment.

15. An arrow rest comprising:

a housing;

a shaft mounted to the housing and having a first end and a second end, the shaft being rotatable between a first position and a second position with an intermediary position therebetween;

a rest mounted to the shaft, wherein the rest is rotatable relative to the shaft; and a biasing device attached to the shaft and flexibly coupling the rest to the shaft, wherein the rest is rotated to a raised state via the biasing device when the shaft is rotated to the first position, the rest is rotated to a dropped state via the biasing device when the shaft is rotated to the intermediary position, and the rest is maintained in the dropped state when the shaft is rotated to the second position; and wherein a load distorts the biasing device only when the shaft is rotated from the intermediary position to the second position.

16. The arrow rest of claim 15, wherein the first position and second position are defined by a rotation limiter affixed to the shaft.

17. The arrow rest of claim 15, further comprising an actuator coupled to the shaft for connecting to a portion of a bow.

18. The arrow rest of claim 15, further comprising a rigid actuation member coupled to the shaft for connecting to a portion of a bow.

19. The arrow rest of claim 15, further comprising a shaft biasing device attached to the shaft, wherein the shaft biasing device biases the shaft and the rest to a particular position.

20. The arrow rest of claim 15, further comprising a targeting adjustment assembly comprising one or more clamping assemblies engaged to one or more tracks, wherein the one or more clamping assemblies are preloaded to engage the one or more tracks with one or more springs.

* * * * *